US006375580B1

(12) United States Patent
Schmidt et al.

(10) Patent No.: US 6,375,580 B1
(45) Date of Patent: Apr. 23, 2002

(54) AUTOMATIC GOLF BALL PLACEMENT DEVICE

(75) Inventors: Karl Schmidt, Wauwatosa, WI (US); Ralph Marshall, Saratosa, FL (US)

(73) Assignee: Gerd Petrik, Sarasota, FL (US)

( * ) Notice: Subject to any disclaimer, the term of this patent is extended or adjusted under 35 U.S.C. 154(b) by 9 days.

(21) Appl. No.: 09/650,710

(22) Filed: Aug. 29, 2000

(51) Int. Cl.[7] ..... A63B 57/00

(52) U.S. Cl. ..... 473/137; 473/132; 473/134; 473/136

(58) Field of Search ..... 473/132, 134, 473/136, 137

(56) References Cited

U.S. PATENT DOCUMENTS 4,817,955 A * 4/1989 Hickson et al.
4,981,299 A 1/1991 Petrillo ..... 273/201
5,282,628 A * 2/1994 Komori et al.
5,326,107 A * 7/1994 Park
5,342,054 A * 8/1994 Chang et al.
5,529,307 A * 6/1996 Chang
5,647,805 A 7/1997 Tarbox ..... 473/137
5,672,124 A * 9/1997 Pecoraro et al.
5,674,130 A 10/1997 Egan ..... 473/132
5,718,638 A 2/1998 Kameda ..... 473/134
5,860,870 A * 1/1999 Park
5,895,325 A 4/1999 Tomey ..... 473/134
5,988,861 A * 11/1999 Baum
6,174,243 B1 * 1/2001 Choi
6,179,719 B1 * 1/2001 Hwang

* cited by examiner

*Primary Examiner*—Paul T. Sewell
*Assistant Examiner*—Nini F. Legesse
(74) *Attorney, Agent, or Firm*—Donald J. Ersler

(57) ABSTRACT

An automatic golf ball dispensing device includes a base, motor, drive link, slide arm, pivot arm, control circuit, dispenser cover, and handle. The base preferably includes two pivot feet on a first end and an adjustable foot on a second end thereof. One end of a drive arm is connected to the shaft of the motor. The other end of the drive arm is pivotally attached to a first end of the drive link. A second end of the drive link is pivotally attached to a second end of the slide arm. The slide arm is slidably attached to a top of the base. A ball stop is formed on a first end of the slide arm and a notch is formed under the ball stop. A first end of the pivot arm is sized to fit under the notch such that the pivot arm is level relative to the top of the base. A ball support extends from a first end of the pivot arm. A bottom of the dispenser cover is attached to a top of the base. A dispensing cavity is formed in the dispenser cover to retain a plurality of golf balls and align the golf balls to be dropped into the ball support. The handle is pivotally attached to a top of the dispenser cover. A control circuit offers three modes of automatic operation.

24 Claims, 10 Drawing Sheets

AUTOMATIC GOLF BALL PLACEMENT DEVICE

BACKGROUND OF THE INVENTION

1. Field of the Invention

The present invention relates generally to teeing golf balls and more specifically to an automatic golf ball placement device which accurately places a golf ball on every type of tee or playing surface.

2. Discussion of the Prior Art

Currently, there are numerous designs of automatic golf ball placement apparatuses. However, there are many drawbacks to these prior art designs. First, most of the automatic golf ball placement apparatuses are large and may not be transported by a user. Second, most of the automatic golf ball placement apparatuses are complicated and have numerous moving parts. The more parts in a device the lower the reliability thereof. Third, most of the automatic golf ball placement apparatuses are not able to place a golf ball on every type of tee, because of their lack of accuracy. If fact, many require special tees, because their lack of accuracy.

Fourth, many automatic ball placement apparatuses are not truly automatic, they require that the user trigger the ball placement in some way. Fifth, many of the automatic ball placement apparatuses are powered AC and not DC. If an electrical outlet is not available, they cannot be used. Sixth, automatic ball placement apparatuses which are truly automatic happen to be very slow. The fastest automatic ball placement apparatus has a five second time interval between ball placements. Seventh, it appears that no portable automatic ball placement apparatus exists which detects when a ball has been hit and replaces the hit ball with another ball. Eighth, due to the complexity of prior art automatic ball placement apparatuses, their corresponding manufacturing cost is also high.

Accordingly, there is a clearly felt need in the art for an automatic golf ball placement device which may be easily transported by a user, does not have a complicated construction, and is accurate enough to place a golf ball on every type of tee.

SUMMARY OF THE INVENTION

The present invention provides an automatic golf ball dispensing device which may be easily transported by a user. The automatic golf ball dispensing device includes a base, motor, drive link, slide arm, pivot arm, control circuit, dispenser cover, and handle. The base preferably includes two pivot feet on one end and an adjustable foot on the other end thereof. Other leveling devices may be used besides the two pivot feet and the adjustable foot. One end of a drive arm is attached to the shaft of the motor. The other end of the drive arm is pivotally attached to a first end of the drive link. A second end of the drive link is pivotally attached to a second end of the slide arm. The slide arm is slidably attached to a top of the base. A ball stop is formed on a first end of the slide arm and a notch is formed under the ball stop. A first end of the pivot arm is sized to fit under the notch such that the pivot arm is level relative to the top of the base.

A ball support extends from a first end of the pivot arm. A knock down pin extends outward from a second end of the pivot arm. A bottom of the dispenser cover is attached to a top of the base. A dispensing cavity is formed in the dispenser cover to retain a plurality of golf balls and to align the golf balls to be dropped into the ball support. The handle is pivotally attached to a top of the dispenser cover.

The automatic golf ball dispensing device operates in the following manner. A plurality of golf balls are placed in the dispensing cavity. The first golf ball will rest in the ball support. The adjustable foot is adjusted to accommodate the tee height or the height of the resting surface. The control circuit may be operated in three different modes. In the first mode, the golf ball is placed after a piezo sensor detects a vibration from tapping or impact. In the second mode, the golf ball is placed according to a user defined time interval. In the third mode, a sensor detects when the golf ball is hit by a golf club and then places another golf ball.

The control circuit enables the motor to rotate. The rotation of the motor causes the drive arm to rotate. The drive arm forces the slide arm and the pivot arm outward from an opening in the first end of the dispensing cover. When the ball support is near a fully extended distance from the first end of the dispensing cover, the motion of the drive arm will cause the second end of the drive link to raise upward. A pin notch on the second of the drive link will lift the knock down pin of the pivoting arm. The ball support will lower and then withdraw from under the golf ball with out moving thereof. The ball support will return to a fully retracted position and wait for the motor to be powered.

Accordingly, it is an object of the present invention to provide an automatic golf ball dispenser device which is easily transported by a user.

It is a further object of the present invention to provide an automatic golf ball dispenser device which has a compact size.

It is yet a further object of the present invention to provide an automatic golf ball dispenser device which has few moving parts.

It is yet a further object of the present invention to provide an automatic golf ball dispenser device which has a low power operating requirement that allows thereof to be operated by batteries.

It is yet a further object of the present invention to provide an automatic golf ball dispenser device which allows a ball to be placed at a particular time interval.

It is yet a further object of the present invention to provide an automatic golf ball dispenser device which allows a ball to be placed at a faster time interval than that of the prior art.

It is yet a further object of the present invention to provide an automatic golf ball dispenser device which senses when the ball has been hit and replaces the hit ball with another ball.

It is yet a further object of the present invention to provide an automatic golf ball dispenser device with a manufacturing cost which is lower than that of the prior art.

Finally, it is another object of the present invention to provide an automatic golf ball dispenser which is accurate enough to place a golf ball on any type of tee.

These and additional objects, advantages, features and benefits of the present invention will become apparent from the following specification.

DETAILED DESCRIPTION OF THE PREFERRED EMBODIMENTS

Figure 1:
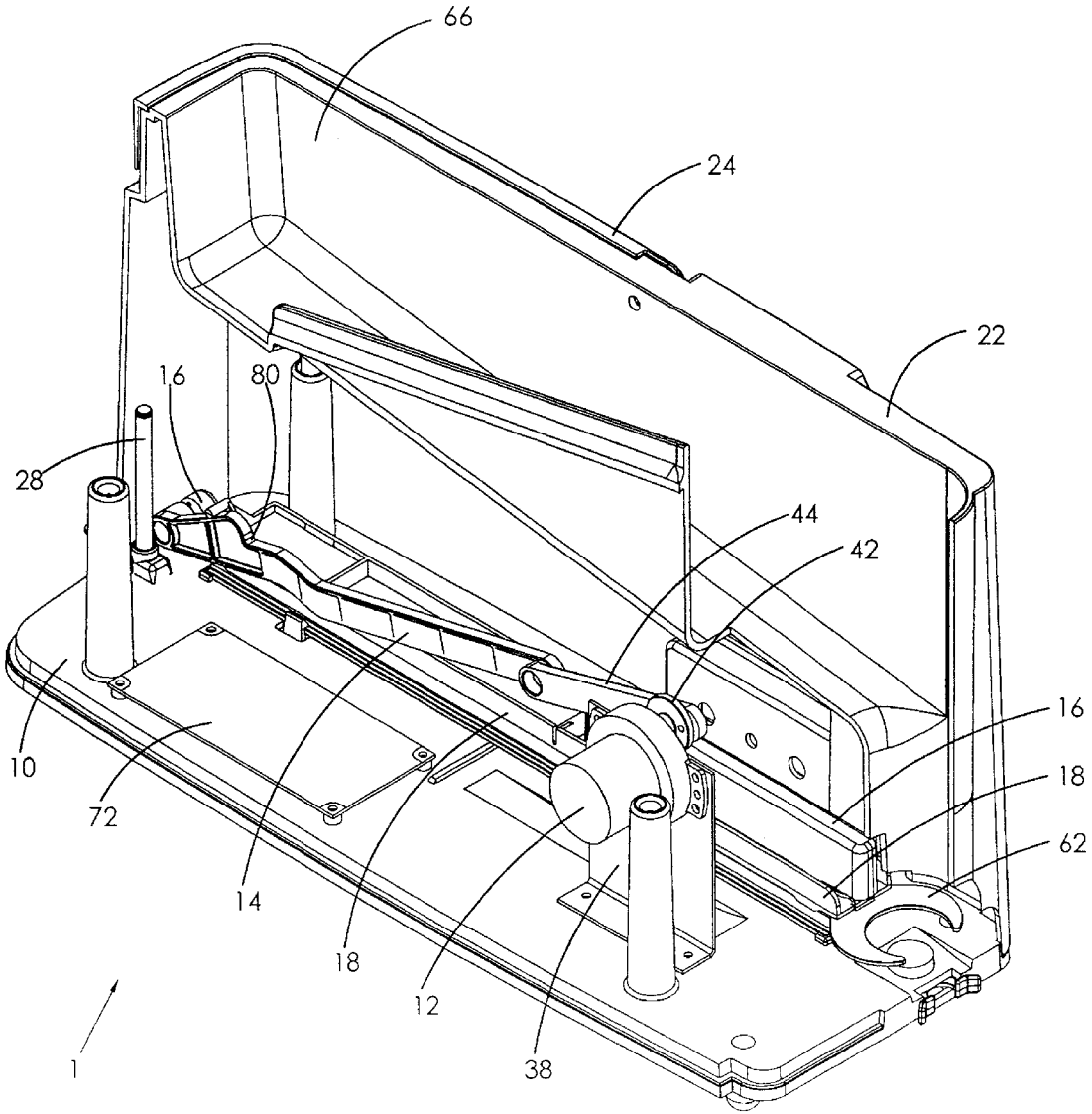
FIG. 1 is a left hand cutaway perspective view of an inside of an automatic golf ball dispensing device in accordance with the present invention.
Figure 2A:
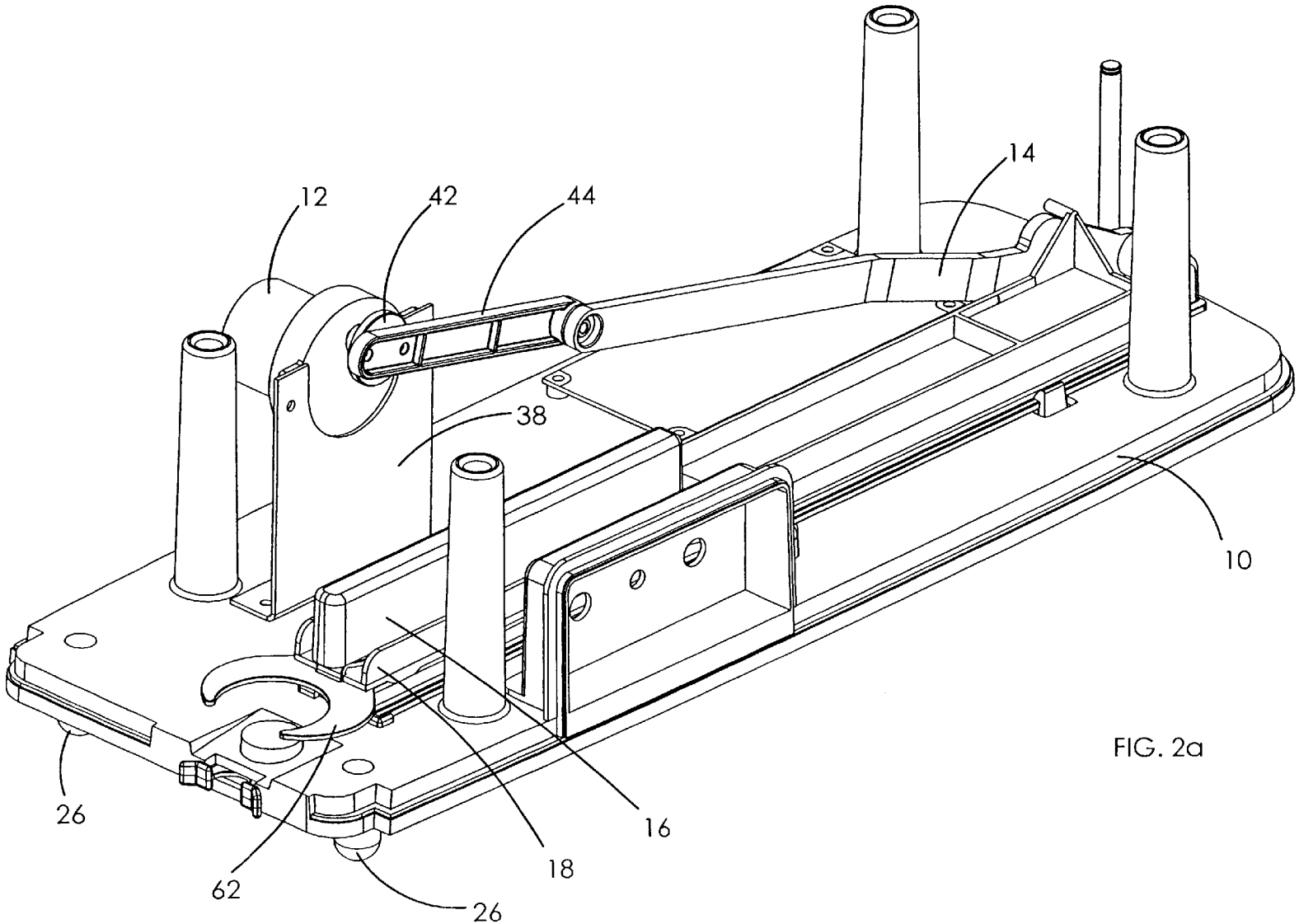
FIG. 2*a* is a right hand perspective view of an automatic golf ball dispensing device with a cover removed and in a fully retracted position in accordance with the present invention.
Figure 2B:
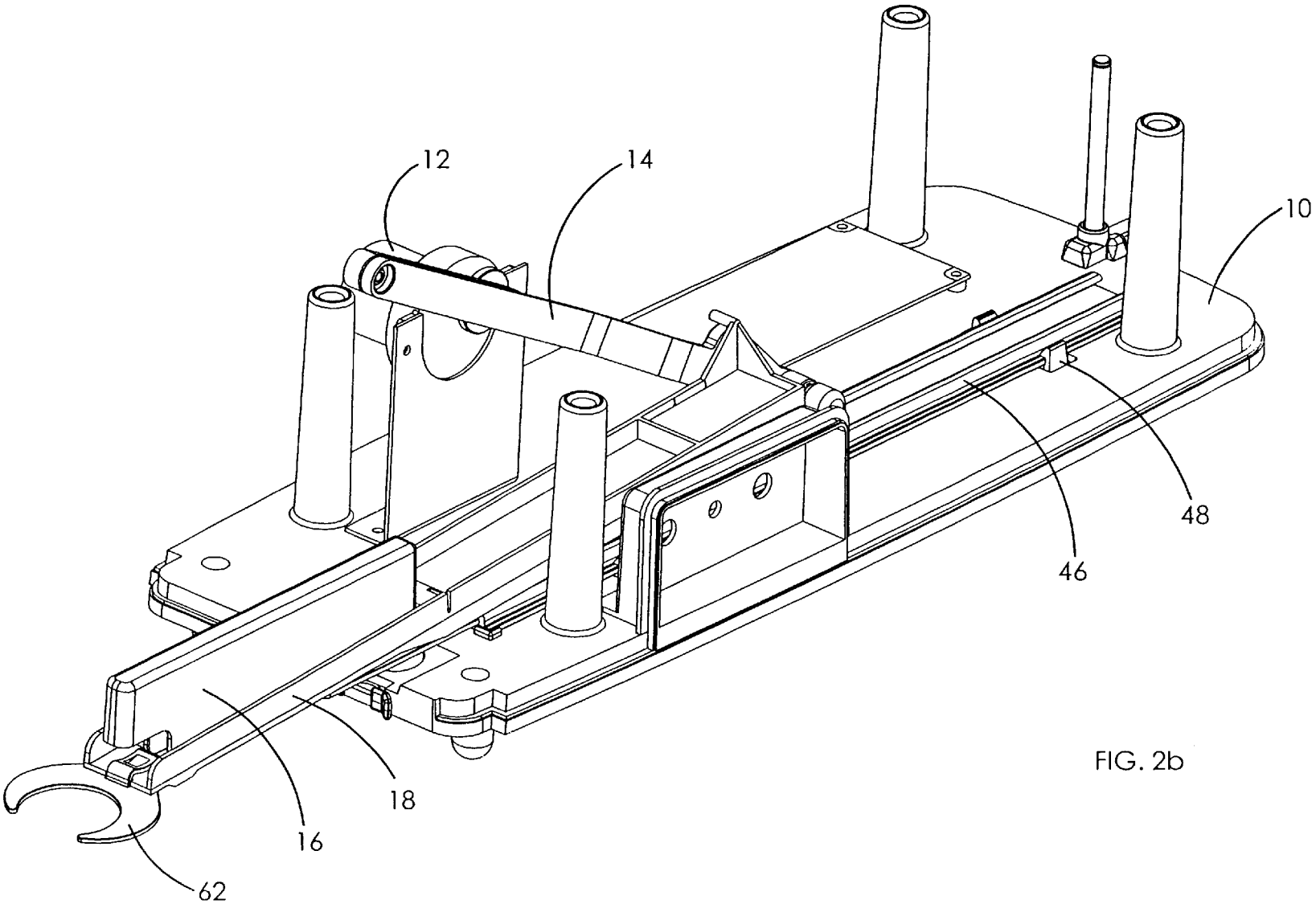
FIG. 2*b* is a right hand perspective view of an automatic golf ball dispensing device with a cover removed and in a fully extended position in accordance with the present invention.
Figure 3:
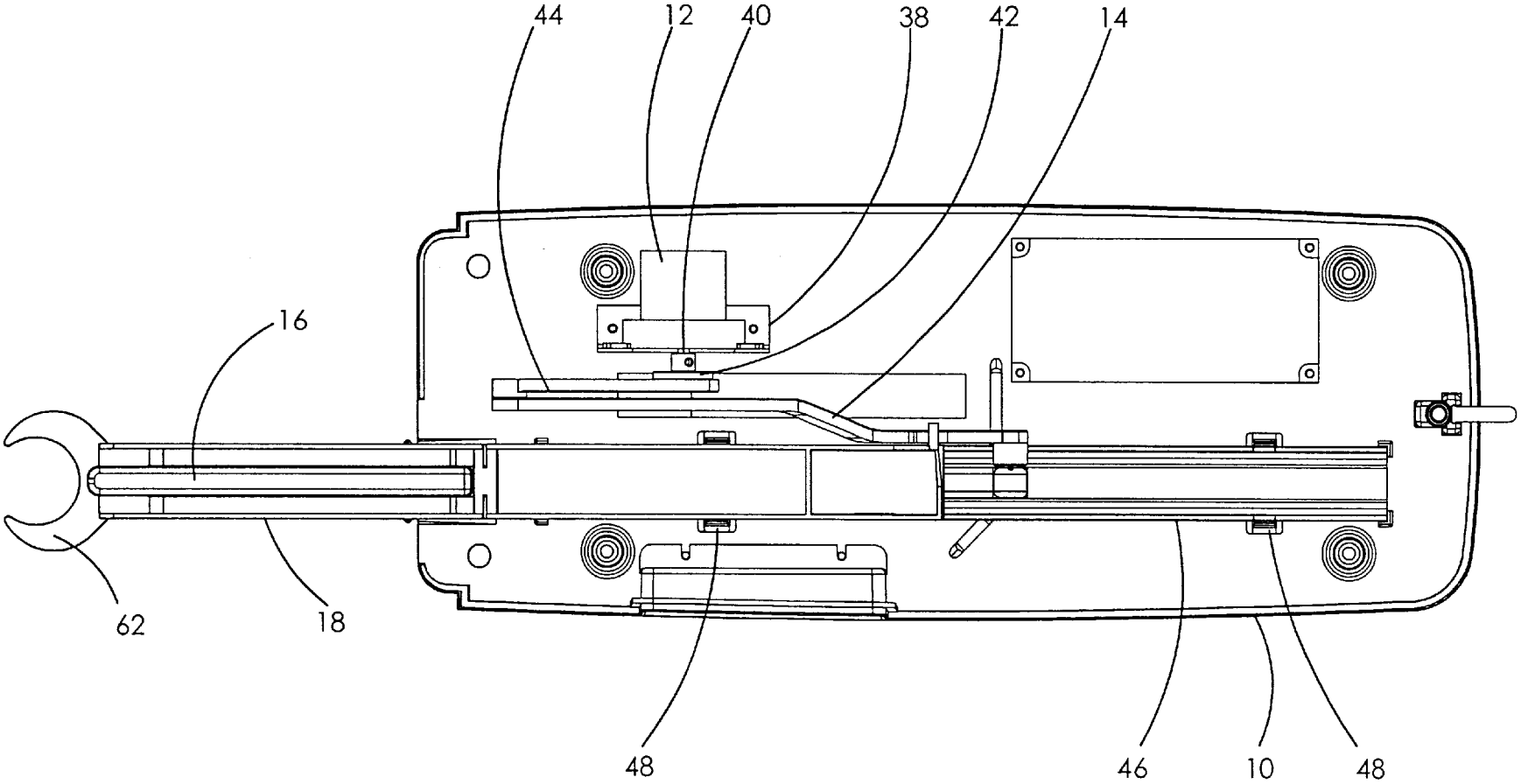
FIG. 3 is a top view of an automatic golf ball dispensing device with the cover removed with the pivot arm in a fully extended position in accordance with the present invention.

With reference now to the drawings, and particularly to FIG. 1, there is shown a left hand cutaway perspective view of an inside of an automatic golf ball dispensing device 1. With reference to FIGS. 2*a*–3, and 9, the automatic golf ball dispensing device 1 includes a base 10, motor 12, drive link 14, slide arm 16, pivot arm 18, control circuit 20, dispenser cover 22, and handle 24. The base 10 preferably includes two pivot feet 26 on one end and an adjustable foot 28 on the other end thereof. FIGS. 1–8 show the two pivot feet 26 on the first end and the adjustable foot 28 on the second end. However, the two pivot feet 26 may be placed on the second end and the adjustable foot 28 on the first end of the base 10. Further, other leveling devices may be used besides the two pivot feet 26 and the adjustable foot 28.

Figure 5:
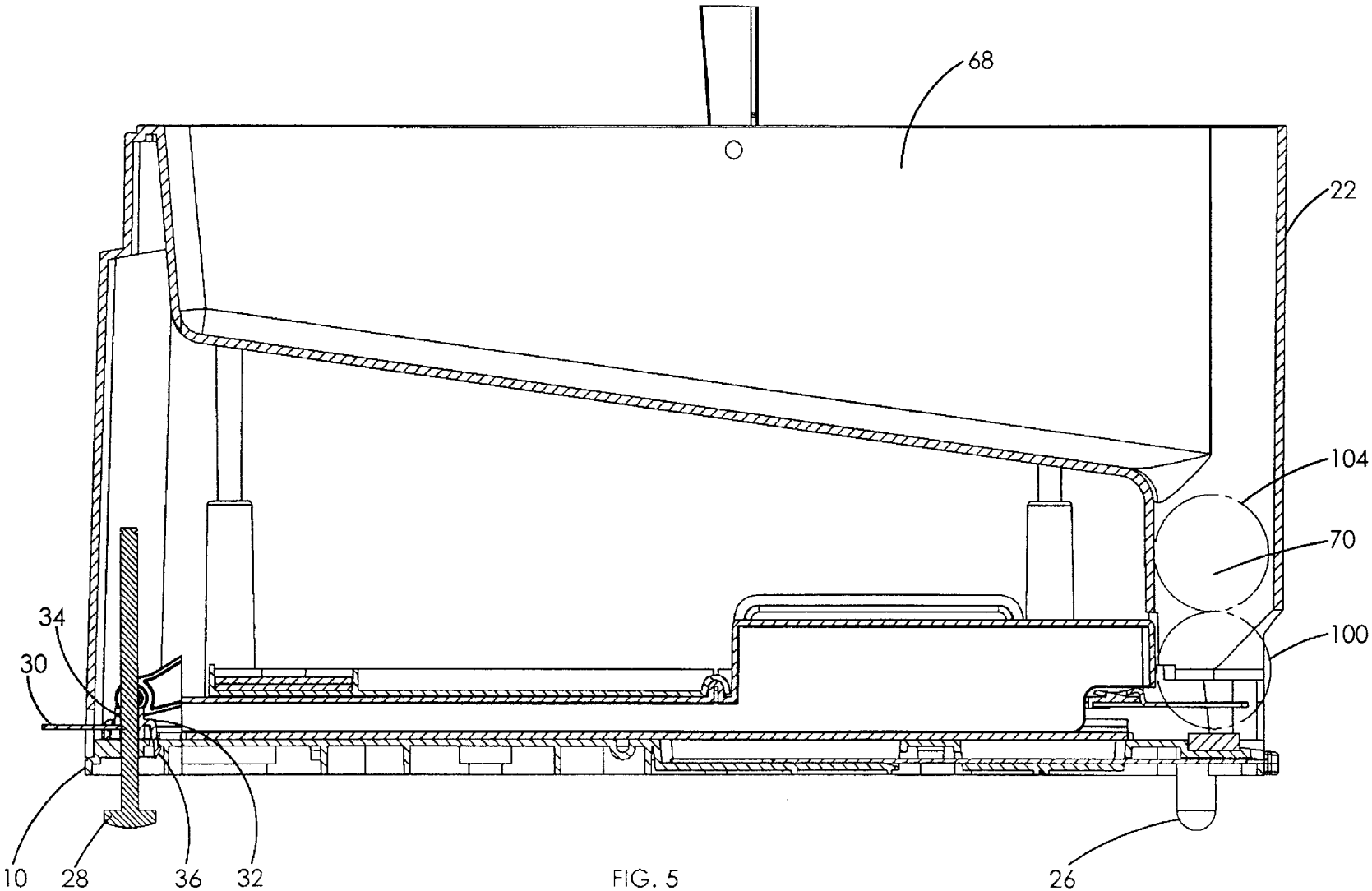
FIG. 5 is a cross sectional view of an automatic golf ball dispensing device in accordance with the present invention.
Figure 6:
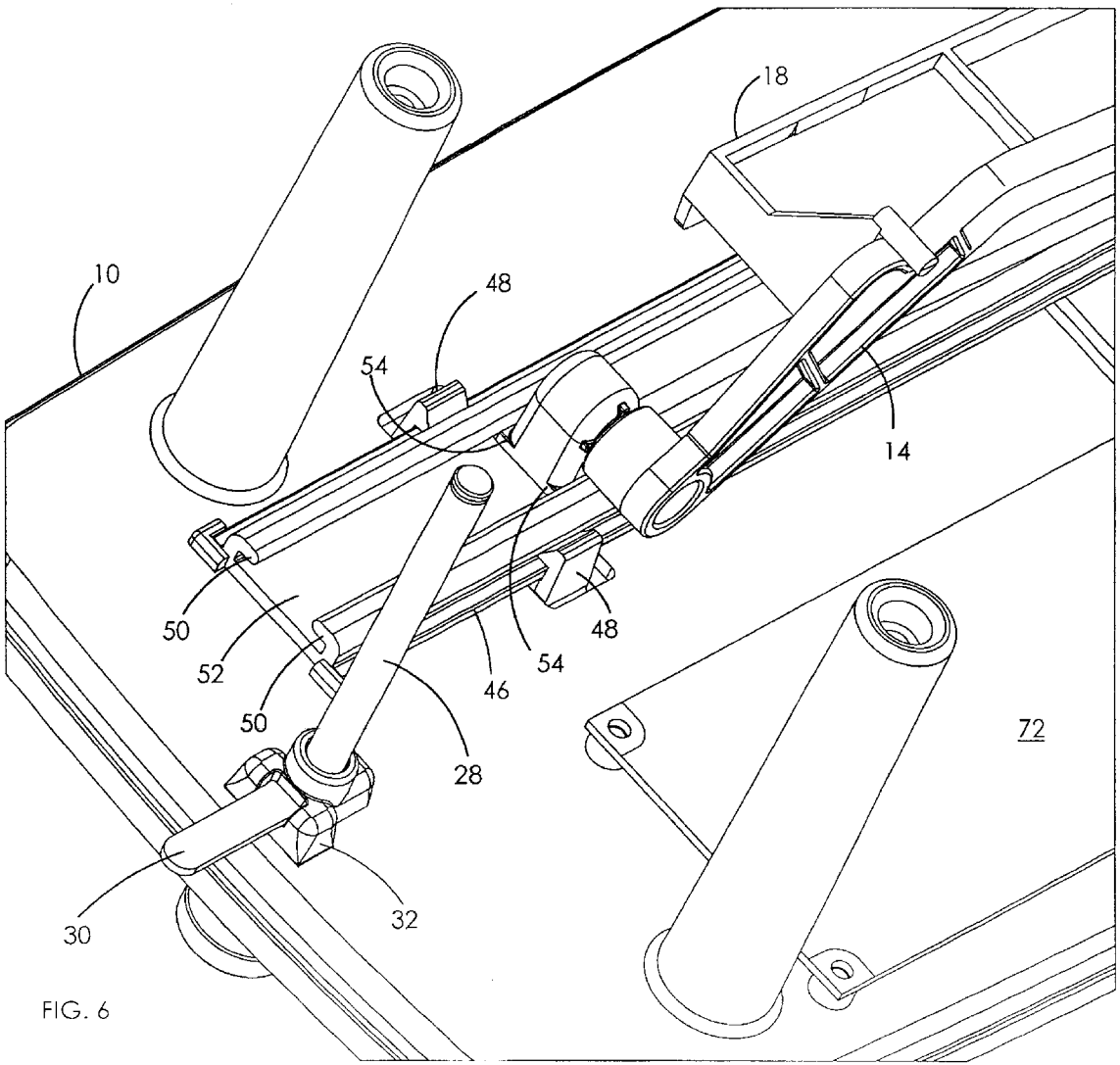
FIG. 6 is an enlarged perspective view of a second end of an automatic golf ball dispensing device in accordance with the present invention.

With reference to FIGS. 5 and 6, the adjustable foot 28 preferably retains its vertical height with a friction lever 30 and a lever housing 32. The friction lever 30 is pivotally retained within the lever housing 32. The lever housing 32 also has a central bore 34 for slidably containing the adjustable foot 28. Pushing down on the friction lever 30 allows the adjustable foot to be moved vertically and thus the height of golf ball placement. A pair of tangs 36 extend from a bottom of the lever housing 32 and a pair of slots are formed in the base 10 to receive the tangs 36. The tangs 36 and slots allow the lever housing 32 to be snapped into a top of the base 10. Other methods of adjusting the height of the adjustable foot 28 may also be used such as threading the adjustable foot 28 into a tapped hole.

A bottom of an L-bracket 38 is attached to a top of the base 10 and the motor 12 is attached to a side at a top of the L-bracket 38. The motor 12 preferably has gear reduction such that numerous rotations of the motor equals one rotation of an output shaft 40. It is preferable that the motor 12 run on a DC voltage supply. Preferably, one end of a drive hub 42 is attached to the output shaft 40 and the other end of the drive hub 42 is attached to one end of the drive arm 44. The other end of the drive arm 44 is pivotally attached to a first end of the drive link 14. A second end of the drive link 14 is pivotally attached to a second end of the slide arm 16.

Figure 8:
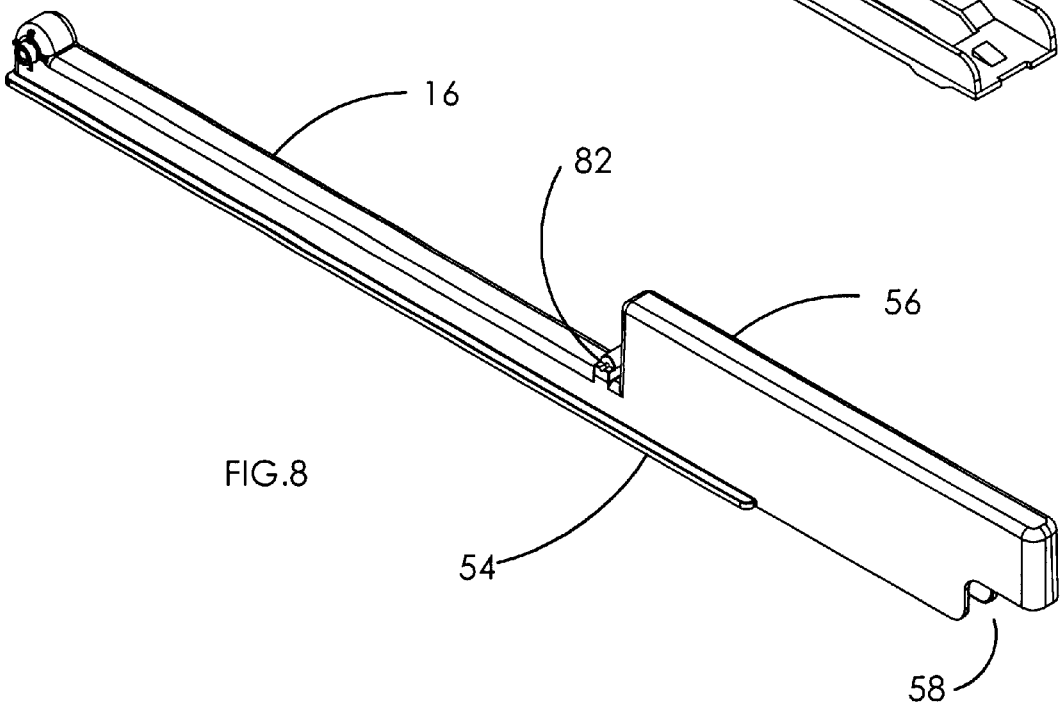
FIG. 8 is a perspective view of a sliding arm of an automatic golf ball dispensing device in accordance with the present invention.

With reference to FIG. 6, a slide rail 46 is preferably attached to the top of the base 10. The slide rail 46 is preferably retained by a top of the base 10 with at least two pairs of snap prongs 48. The slide rail 46 may also be attached to the top of the base 10 with any suitable attachment method. The slide rail 46 could also be formed as an integral part of the top of the base 10. A cross section of the slide rail 46 shows two horizontal fingers 50 extending across both ends of a guide slot 52. With reference to FIG. 8, a pair of retention ledges 54 are formed on opposing bottom edges of the sliding arm 16. The retention ledges 54 are sized to slide within the guide slot 52. A ball stop 56 is formed on a first end of the slide arm 16 and a notch 58 is formed under the ball guide 56.

Figure 7:
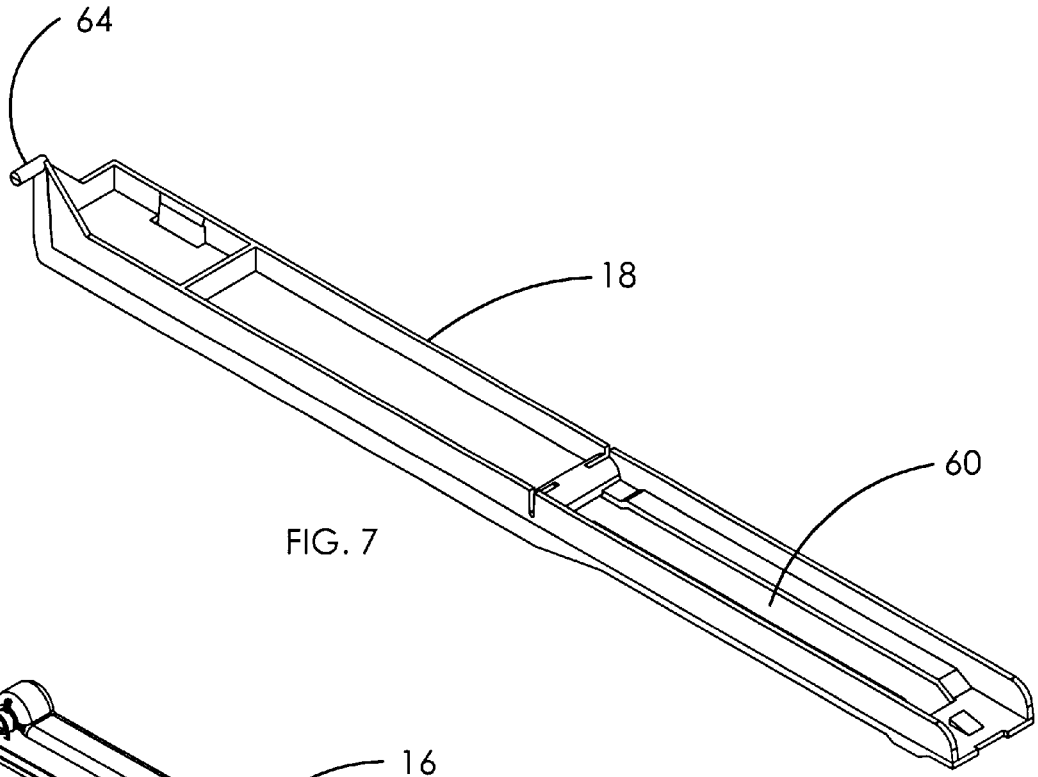
FIG. 7 is a perspective view of a pivoting arm of an automatic golf ball dispensing device in accordance with the present invention.

With reference to FIG. 7, a first end of the pivot arm 18 has a clearance slot 60 formed through substantially a first end which allows thereof to fit under the notch 58 such that the pivot arm 18 is level with the top of the base 10. The clearance slot 60 is sized to receive the ball stop 56 of the slide arm 16. A ball support 62 may be attached to the first end of the pivot arm 18 or the ball support 62 may be formed as an integral part of the pivot arm 8. A knock down pin 64 extends outward from a second end of the pivot arm 18.

A bottom of the dispenser cover 22 is attached to a top of the base 10. A dispensing cavity 66 is formed in the dispenser cover 22 to retain a plurality of golf balls and align the golf balls 100 to be dropped into the ball support 62. The dispensing cavity 66 includes a hopper area 68 and a drop area 70. A bottom of the hopper 68 is sloped such that the golf balls 100 naturally roll toward the drop area 70. The handle 24 is pivotally attached to a top of the dispenser cover 22.

Figure 9:
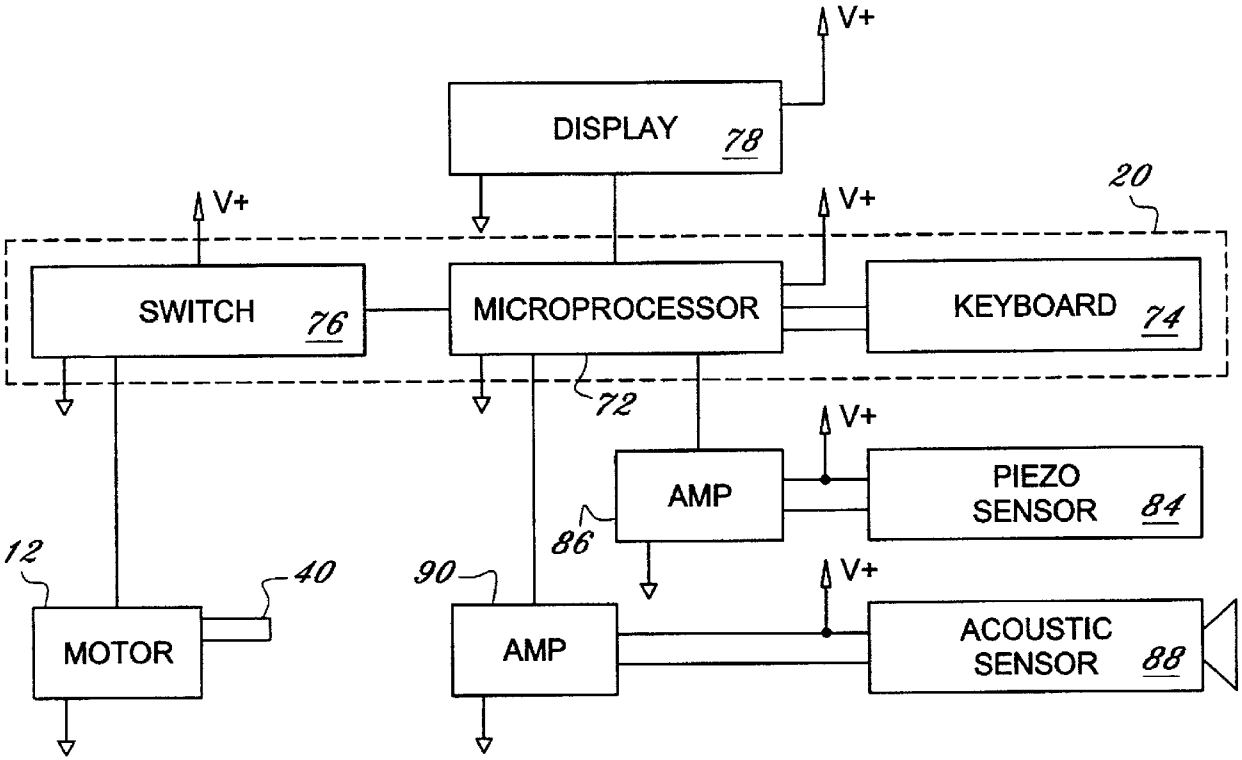
FIG. 9 is a schematic diagram of a control circuit of an automatic golf ball dispensing device in accordance with the present invention.

FIG. 9 shows a schematic diagram of the control circuit 20 of the automatic golf ball dispensing device 1. The control circuit 20 includes a microprocessor board 72, a current switch 76, and a keyboard 74. The control circuit 20 preferably provides three modes of operation. The keyboard 74 is used to choose between one of the three modes. The microprocessor board 72 contains a program which receives input from the keyboard 74. The microprocessor 72 is triggered into cycling the ball support 62 by one of the three modes. In response to the triggering, the microprocessor 72 turns on the current switch 76 for a period of time that is long enough to cycle the movement of the ball support 62 through the motor 12.

Figure 10:
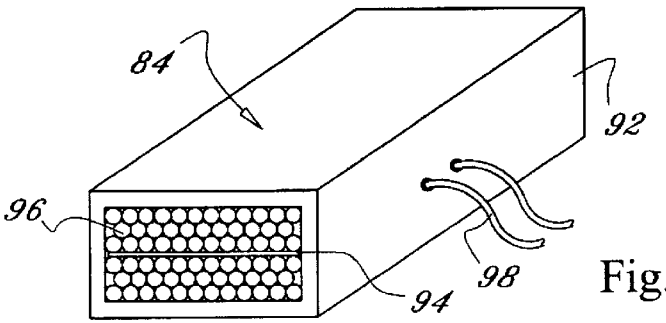
FIG. 10 is a cross sectional view of a sensor of an automatic golf ball dispensing device in accordance with the present invention.

If the first mode is chosen, the golf ball 100 is placed after a piezo sensor 84 detects a vibration from tapping or impact. With reference to FIG. 10, the sensor 84 includes a container 92, a piece of piezo electric film 94, and a filler material 96. The piezo sensor 84 is preferably positioned to enable a golfer to tap the piezo sensor 84 with a golf club without having to change their stance. The piezo electric film 94 is retained within the filler material 96 and the filler material 96 is contained within the container 92. The filler material 96 is preferably lead shot, but could be other materials, items, or objects which do not damage the piezo electric film 94, yet transmit vibration. The piezo sensor 84 could also be the piezo electric film 94 covered by rubber or some other protective material. The protective material must be capable of transmitting vibration. The piezo electric film 94 is connected to a pair of wires 98 which extend from the automatic golf ball placement device 1. The piezo electric film 94 detects vibration. An electrical signal is sent from the piezo electric film 94 to preferably a current amplifier 86. The current amplifier 86 is connected to one of the input ports of the microprocessor 72. The current amplifier 86 provides the drive to send a readable electrical signal to the microprocessor 72. A vibration sufficient to trigger placement of a golf ball 100 is generated by tapping a golf ball 100 or by tapping the piezo sensor 94.

The location of the piezo sensor 84 relative to the tee will determine whether the piezo sensor 84 needs to be tapped, or will work automatically after a golf ball 100 is hit. If the piezo sensor 84 is close enough to the tee to sense the vibration from the impact of the golf ball 100 being hit, the next golf ball 100 will be placed automatically. Otherwise, the piezo sensor 84 will have to be tapped to place the next golf ball 100.

If the second mode is chosen, the golf ball 100 is placed according to a user defined time interval. The program reads a time interval between tee-ups input from the keyboard 74. The preferable interval of ball placement is (2–99) seconds.

If the third mode is chosen, a sensor detects when the golf ball 100 is hit by a golf club and places a second golf ball 104. The acoustic sensor 88 detects the sound waves generated by the hit of the golf ball 100. A signal is sent from the acoustic sensor 88 to preferably a voltage amplifier 90. The voltage amplifier 90 is connected to one of the input ports of the microprocessor 72. The voltage amplifier 90 increases the magnitude of the electrical signal, so the microprocessor 72 can read a "high" voltage.

Other methods may be used to set the interval besides the microprocessor based control circuit 20. A display 78 may be used to show the mode, time interval, the number of balls hit, how much time was spent hitting the balls and other information. It is preferably that a liquid crystal type of display be used. The motor 12, microprocessor board 72, keyboard 74, and current switch 76 are supplied with power from a DC battery, a DC power adapter, or any other suitable electrical source. DC battery power includes the use of six "C" size dry cell batteries.

The automatic golf ball dispensing device 1 operates in the following manner. A plurality of golf balls are placed in the dispensing cavity 22. The first golf ball 100 will rest in the ball support 62. The friction lever 30 is depressed and the height of the automatic golf ball dispensing device 1 is adjusted to accommodate the tee height or the height of the resting surface. One of the three modes is chosen to facilitate golf ball placements. The control circuit 20 is triggered by one of the three modes. The rotation of the drive shaft 40 causes the drive arm 44 to rotate. The drive arm 44 forces the slide arm 16 and the pivot arm 18 to extend outward from an opening in the first end of the dispensing cover 22.

The ball stop 56 prevents a second golf ball 104 from rolling on to the first golf ball 100 when the sliding arm 16 is in an extended position. After the ball support 62 is near a maximum distance from the first end of the dispensing cover 22, the motion of the drive arm 44 will cause the second end of the drive link 14 to raise upward. A pin notch 80 formed on the second end of the drive link 14 will lift the knock down pin 64 of the pivoting arm 18. The pivoting arm 18 pivots about the sliding arm at a pivot surface 82 located behind the ball stop 56 when the second end of the pivoting arm is lifted by the drive link 14.

Figure 4A:
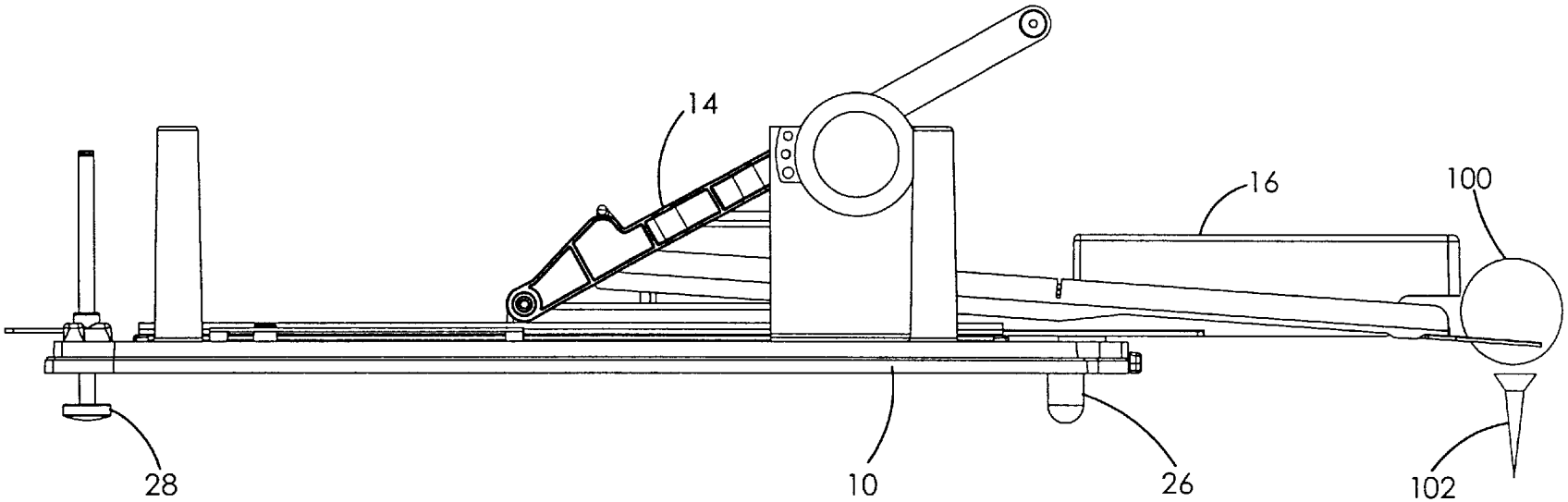
FIG. 4*a* is a left hand side view of an automatic golf ball dispensing device with the pivot arm before being lowered at a first end thereof in accordance with the present invention.
Figure 4B:
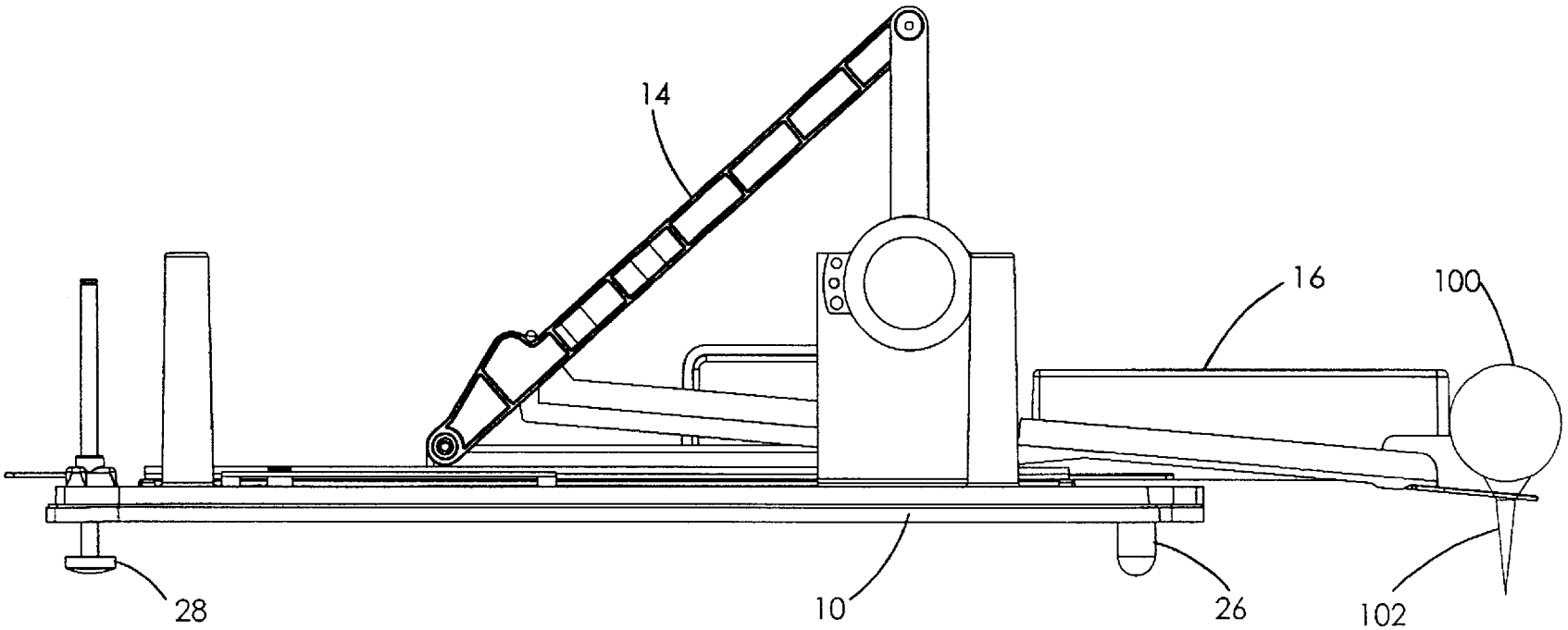
FIG. 4*b* is a left hand side view of an automatic golf ball dispensing device with the pivot arm being lowered at a first end thereof in accordance with the present invention.

With reference to FIGS. 4*a* and 4*b*, lifting the second end of the pivoting arm 18 will cause the first end of the pivoting arm 18 to lower with the ball support 62. The ball support 62 lowers below a bottom of the golf ball 100 and then retracts into the dispensing cover 22. The golf ball 100 will rest on the tee 102 or on any other desired surface. The ball support 62 will return to a fully retracted position and wait for the motor 12 to be supplied with power.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An automatic golf ball dispensing device comprising:

a base;

a motor mounted above said base;

a drive link having one end driven by said motor and a pin notch being formed on the other end thereof;

a pivot arm having a ball support extending from one end and a knock down pin extending outward from the other end thereof;

a sliding arm being slidably attached to said base, said sliding arm having a pivotal relationship with said pivot arm near one end thereof, the other end of said sliding arm being pivotally attached to the other end of said drive link, wherein said knock down pin mating with said pin notch to lift said other end of said pivot arm to allow said ball support to be withdrawn from under a golf ball; and a dispensing cover having the capacity to retain a plurality of golf balls and to feed a single ball into said ball support.

2. The automatic golf ball dispensing device of claim 1, comprising:

a handle being pivotally attached to a top of said dispensing cover.

3. The automatic golf ball dispensing device of claim 1, comprising:

a control circuit controlling the rotation of said motor.

4. The automatic golf ball dispensing device of claim 3, further comprising:

said control circuit having a microprocessor board, a keyboard and a high current switch, said microprocessor being used to program the interval of time between the placements of a golf ball, said microprocessor enabling said high current switch to obtain rotation from said motor.

5. The automatic golf ball dispensing device of claim 3, further comprising:

said control circuit having a microprocessor board, a keyboard and a high current switch, said microprocessor receiving an electrical signal from a piezo sensor to implement a golf ball placement, said microprocessor enabling said high current switch to obtain rotation from said motor.

6. The automatic golf ball dispensing device of claim 3, further comprising:

said control circuit having a microprocessor board, a keyboard and a high current switch, said microprocessor receiving an electrical signal from an acoustic sensor to implement a golf ball placement, said microprocessor enabling said high current switch to obtain rotation from said motor.

7. The automatic golf ball dispensing device of claim 1, further comprising:

a drive arm, one end of said drive arm being attached to an output shaft of said motor, the other end of said drive arm being pivotally attached to one end of said drive link.

8. The automatic golf ball dispensing device of claim 1, further comprising:

said output shaft of said motor moving at a speed which is slower than said motor.

9. The automatic golf ball dispensing device of claim 1, further comprising:

a pair of pivot feet being formed on one end of said base and an adjustable foot being slidably attached to the other end thereof, one of said ends of said base being raised and lowered with a friction lever.

10. An automatic golf ball dispensing device comprising:

a base;

a motor mounted above said base;

a control circuit controlling the rotation of said motor;

a drive link having one end driven by said motor and a pin notch being formed on the other end thereof;

a pivot arm having a ball support extending from one end and a knock down pin extending outward from the other end thereof;

a sliding arm being slidably attached to said base, said sliding arm having a pivotal relationship with said pivot arm near one end thereof, the other end of said sliding arm being pivotally attached to the other end of said drive link, wherein rotation of said drive link causing said sliding arm to move to an extended position, said knock down pin mating with said pin notch to lift said other end of said pivot arm to allow said ball support to be withdrawn from under a golf ball; and a dispensing cover having the capacity to retain a plurality of golf balls and to feed a single ball into said ball support.

11. The automatic golf ball dispensing device of claim 10, comprising:

a handle being pivotally attached to a top of said dispensing cover.

12. The automatic golf ball dispensing device of claim 10, further comprising:

said control circuit having a microprocessor board, a keyboard and a high current switch, said microprocessor being used to program the interval of time between the placements of a golf ball, said microprocessor enabling said high current switch to obtain rotation from said motor.

13. The automatic golf ball dispensing device of claim 10, further comprising:

said control circuit having a microprocessor board, a keyboard and a high current switch, said microprocessor receiving an electrical signal from a piezo sensor to implement a golf ball placement, said microprocessor enabling said high current switch to obtain rotation from said motor.

14. The automatic golf ball dispensing device of claim 10, further comprising:

said control circuit having a microprocessor board, a keyboard and a high current switch, said microprocessor receiving an electrical signal from an acoustic sensor to implement a golf ball placement, said microprocessor enabling said high current switch to obtain rotation from said motor.

15. The automatic golf ball dispensing device of claim 10, further comprising:

a drive arm, one end of said drive arm being attached to an output shaft of said motor, the other end of said drive arm being pivotally attached to one end of said drive link.

16. The automatic golf ball dispensing device of claim 10, further comprising:

said output shaft of said motor moving at a speed which is slower than said motor.

17. The automatic golf ball dispensing device of claim 10, further comprising:

a pair of pivot feet being formed on one end of said base and an adjustable foot being slidably attached to the other end thereof, one of said ends of said base being raised and lowered with a friction lever.

18. An automatic golf ball dispensing device comprising;

a base;

a motor mounted above said base;

a control circuit controlling the rotation of said motor;

a drive arm having one end attached to an output shaft of said motor;

a drive link having one end driven by the other end of said drive arm and a pin notch being formed on the other end of said drive link;

a pivot arm having a ball support extending from one end and a knock down pin extending outward from the other end thereof;

a sliding arm being slidably attached to said base, said sliding arm having a pivotal relationship with said pivot arm near one end thereof, the other end of said sliding arm being pivotally attached to the other end of said drive link, wherein rotation of said drive link causing said sliding arm to move an extended position, said knock down pin mating with said pin notch to lift said other end of said pivot arm to allow said ball support to be withdrawn from under a golf ball; and a dispensing cover having the capacity to retain a plurality of golf balls and to feed a single ball into said ball support.

19. The automatic golf ball dispensing device of claim 18, comprising:

a handle being pivotally attached to a top of said dispensing cover.

20. The automatic golf ball dispensing device of claim 18, further comprising:

said control circuit having a microprocessor board, a keyboard and a high current switch, said microprocessor being used to program the interval of time between the placements of a golf ball, said microprocessor enabling said high current switch to obtain rotation from said motor.

21. The automatic golf ball dispensing device of claim 18, further comprising:

said control circuit having a microprocessor board, a keyboard and a high current switch, said microprocessor receiving an electrical signal from a piezo sensor to implement a golf ball placement, said microprocessor enabling said high current switch to obtain rotation from said motor.

22. The automatic golf ball dispensing device of claim 18, further comprising:

said control circuit having a microprocessor board, a keyboard and a high current switch, said microprocessor receiving an electrical signal from an acoustic sensor to implement a golf ball placement, said microprocessor enabling said high current switch to obtain rotation from said motor.

23. The automatic golf ball dispensing device of claim 18, further comprising:

said output shaft of said motor moving at a speed which is slower than said motor.

24. The automatic golf ball dispensing device of claim 18, further comprising:

a pair of pivot feet being formed on one end of said base and an adjustable foot being slidably attached to the other end thereof, one of said ends of said base being raised and lowered with a friction lever.

* * * * *